United States Patent [19]

Lohrberg et al.

[11] 3,951,767

[45] Apr. 20, 1976

[54] METHOD AND APPARATUS FOR THE ELECTROLYSIS OF ALKALI METAL CHLORIDES

[75] Inventors: Karl Lohrberg, Heusenstamm; Günther Haas, Weisskirchen; Jürgen Müller, Frankfurt am Main, all of Germany

[73] Assignee: Metallgesellschaft Aktiengesellschaft, Frankfurt am Main, Germany

[22] Filed: Mar. 1, 1974

[21] Appl. No.: 447,405

[30] Foreign Application Priority Data

May 29, 1973 Germany ..... 2327303

[52] U.S. Cl. ..... 204/99; 204/128; 204/250; 204/251; 204/286; 204/294

[51] Int. Cl.[2] ..... C25B 1/40; C25B 1/26; C25B 11/02; C25B 9/00

[58] Field of Search ..... 204/98, 99, 128, 250, 204/251, 286, 128, 294

[56] References Cited

UNITED STATES PATENTS

| | | | |
|---|---|---|---|
| 3,268,427 | 8/1966 | Schücker | 204/250 |
| 3,308,043 | 3/1967 | Loftfield et al. | 204/124 |
| 3,409,533 | 11/1968 | Murayama et al. | 204/250 |
| 3,535,223 | 10/1970 | Baecklund et al. | 204/275 |
| 3,558,404 | 1/1971 | Danna | 204/250 |
| 3,676,325 | 7/1972 | Smith et al. | 204/250 |
| 3,689,384 | 9/1972 | Barbato et al. | 204/99 |
| 3,725,223 | 4/1973 | De Nora et al. | 204/250 |
| 3,759,812 | 9/1973 | Koziol et al. | 204/250 |
| 3,795,603 | 3/1974 | Glos et al. | 204/250 |

FOREIGN PATENTS OR APPLICATIONS

| | | |
|---|---|---|
| 708,023 | 4/1954 | United Kingdom |
| 1,061,446 | 3/1967 | United Kingdom |
| 1,203,361 | 8/1970 | United Kingdom |
| 1,308,119 | 2/1973 | United Kingdom |

*Primary Examiner*—R. L. Andrews
*Attorney, Agent, or Firm*—Burgess, Dinklage & Sprung

[57] ABSTRACT

Alkali metal chlorides, e.g. brine, are electrolized in the presence of substantially horizontal anodes provided on the underside with channel- or groove-like recesses. The anodes and/or the course of the channel- or groove-like recesses in the anodes are positioned to define spaced apart regions between the anodes so as to provide for an outflow of chlorine from the space between the electrodes and for an inflow of brine into this space.

8 Claims, 6 Drawing Figures

METHOD AND APPARATUS FOR THE ELECTROLYSIS OF ALKALI METAL CHLORIDES

BACKGROUND

This invention relates to a method of operating mercury cells for the electrolysis of alkali metal chlorides, which comprise virtually horizontal anodes, which are provided on the underside with channel- or groovelike recesses.

It is known that in the electrolysis of alkali metal chlorides the electrode voltage at the gas-producing anode is higher than would correspond to the thermodynamic equilibrium conditions. This phenomenon accounts for part of the overvoltage and is due to the fact that the gas bubbles formed by the electrolysis cover part of the anode surface and block this part of the surface for the flow of electric current. As a result, if the electric current is predetermined, a correspondingly higher electric current will flow through adjacent portions of the anode. The local increase of the electric current results necessarily in a higher voltage in this area. This voltage rise is virtually quantitatively converted into heat and results in a temperature rise of the anode surface. Because the gas cushion on the surface of the anode opposes a rapid exchange of heat, with the electrolyte, there is a relatively poor dissipation of said heat. Eventually, infinitesimal areas of the electrode surface are heated to temperatures exceed 100°C. and are responsible, inter alia, for a corrosion of the anode.

Numerous proposals have been made with the object to reduce this economically undesired overvoltage and to restrict the attack of the electrode surface. For this purpose the anode has been provided with a multiplicity of cylindrical holes or of slots, through which the chlorine gas which has been produced is discharged as rapidly as possible (Opened German Application 1,667,812; 1,792,183; British Patent 1,229,402). In such arrangements it is useful to provide gas flow areas of an order of 15–35%. Larger gas flow areas are avoided because they would involve an excessive effective current density and as a result, an increase of the activation overvoltage. The same purpose is served by numerous proposals for the design of metal anodes, which are made, e.g., of expanded metal, slotted sheet metal elements, or arrangements similar to woven fabrics.

Where the previous proposals are adopted, the gas flows to the surface of the electrolyte along the shortest path which is available and the potential energy possessed by the gas as a result of the hydrostatic pressure of the electrolyte is dissipated at random or, more properly speaking, an unoriented turbulence is produced in the electrolyte. A presence of gas bubbles dispersed in the brine cannot be avoided in the space between the electrodes.

The German Utility Model 7,207,894 describes a further development regarding the design of the flow passages for gas produced by the electrolysis. In that case, the flow passages should be enlarged at least close to and toward one surface of the electrode and may have the shape of a Venturi passages. Whereas that proposal does result in substantial improvements, it cannot entirely prevent gas which leaves a flow passage from entering the suction range of the liquid which flows into the space between the electrodes and from being entrained by said liquid.

In another method of operating cells having a flowing mercury cathode and used for the electrolysis of alkali metal salts, the cover and bottom of the cell are parallel and equally spaced and have an inclination of 2–85° from the horizontal and the cell is filled with electrolyte virtually to the uppermost corner (Printed German Application 1,467,23). It is the object of that arrangement to transmit to the electrolyte the buoyant force exerted on the gas bubbles and thus to effect a circulation in the electrolytic cell so that the gas bubbles are rapidly swept from the anodes. In this connection it is stated that perforated anodes are desirable and that notched or slotted anodes may be used in order to conduct the gas bubbles to the edges of the anode. On the other hand, that proposal has the disadvantage that a large overall height is required and that the filling of the cell to the uppermost corner gives rise to sealing problems at the cover of the cell. These sealing problems will be aggravated since the hydrostatic pressure is increased by a larger inclination of the cell. In that case too an entraining of rising gas bubbles into the space between the electrodes by the suction of the electrolyte cannot be avoided. Finally, the forced circulation of the electrolyte in the cell space above the anodes obstructs the free discharge of the gas which has been produced under the anodes.

SUMMARY

It is an object of the invention to avoide known disadvantages and to provide a method which does not involve additional structural expenditure and can be carried out in existing equipment with small alterations thereof and which enables particularly an undisturbed movement of the brine and a high rate of discharge of chlorine gas which has been produced so that the previously encountered corrosion of anodes is eliminated or at least substantially alleviated.

In a method of operating mercury cells for the electrolysis of alkali metal chlorides, this object is accomplished in that virtually horizontal anodes, which are provided on the underside with channel- or groovelike rescesses, are so designed in accordance with the invention that the arrangement of the anodes and/or the course of the channel- or groovelike rescesses, are selected to provide spaced apart regions between the anodes for an outflow of chlorine from the space between the electrodes and for an inflow of brine into said space.

DESCRIPTION OF THE DRAWING

The invention will be described more fully and by way of example with reference to the accompanying diagrammatic drawings in which.

DESCRIPTION

The invention may be performed in various ways. For instance, anodes may be used which have uniform channel- or groovelike recesses and which consist, e.g., of graphite anodes which are milled to a constant depth, if a partition is provided approximately midway between two adjacent anodes. That partition prevents a mixing of the gas-brine dispersion emerging from the recesses of one anode and the brine which enters the space between the adjacent anode and the mercury.

In another embodiment, partitions are also used and the channel- or groovelike recess increases in depth in the direction of flow of the mercury so that the gas-brine dispersion flows in the same direction as the mercury and the latter promotes the gas-brine flow, which is in the same direction.

In particularly desirable embodiment, the bottoms of the channel- or groovelike recesses of adjacent anodes are inclined in mutually opposite senses from the horizontal. In that case, alternate spaces between adjacent anodes of a series of anodes will be available for an outflow of chlorine and for an inflow of brine. As a result, a mixing of the outflowing gas-sole dispersion and of brine which enters the space between the electrodes is prevented only in that adjacent inflow and outflow areas are spaced apart by the length of an anode whereas there is no need for a partition.

It will be desirable if the area of the channel-or groovelike recesses is suitably 20–80 %, preferably 40–60 % of the entire area of the undersurface of the anode. To facilitate the manufacture, the recess will have the same width, as a rule. The invention may be used in comjunction with anodes made from any of the conventional materials. In the preferred electrodes made of carbon, such as graphite, the recesses can be made most simply by milling. In anodes of metal, such as surface-activated titanium, the recesses are suitably provided by appropriate shaping operations, such as creasing or pressing, before the anodes are activated.

In providing the recesses, care should be taken to avoid apertures or perforations extending through the thickness of the anode because they would give rise to a turbulence which would adversely affect the directed and for this reason, rapid flow of the gas-brine fluid and the brine.

The invention enables the use of low mercury cells for the electrolysis. The arrangement according to the invention is independent of the inclination of the cell. There will be no sealing problems because the upper portion of the cell space, adjacent to the cover, is filled only with chlorine gas. An escape of chlorine can reliably be prevented by the application of a vacuum.

Under the anodes, the gas-brine fluid flows at a velocity of an order of about 1 meter per second so that an adherence of gas bubbles is prevented and a uniform temperature throughout the anode surface is ensured. Finally, the high velocity of flow ensures an optimum cooling of the anodes.

Figure 1:
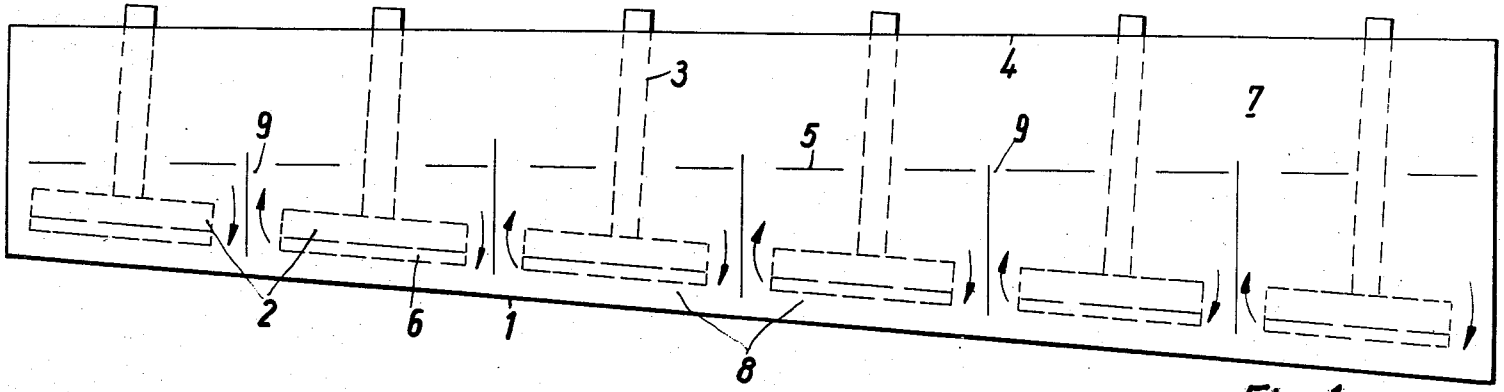
FIG. 1 is a side view of a mercury-type electrolytic cell having anodes (shown in phantom) with uniform channel-or groovelike recesses and partitions.
Figure 3:
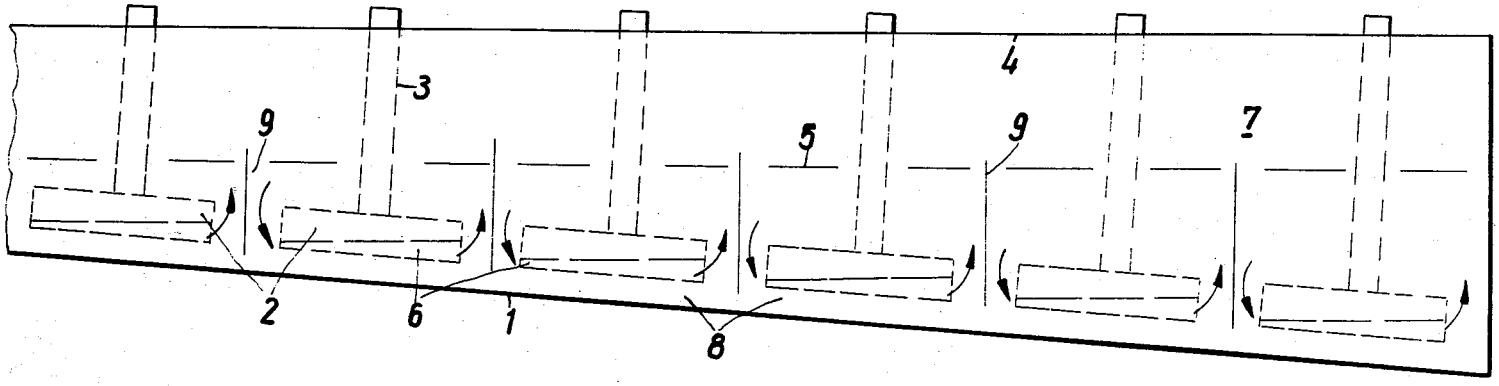
FIG. 3 is a side view of a mercury-type electrolytic cell having anodes (shown in phantom) formed with channel-or groovelike recesses which increase in depth in the direction of flow of the mercury.
Figure 5:
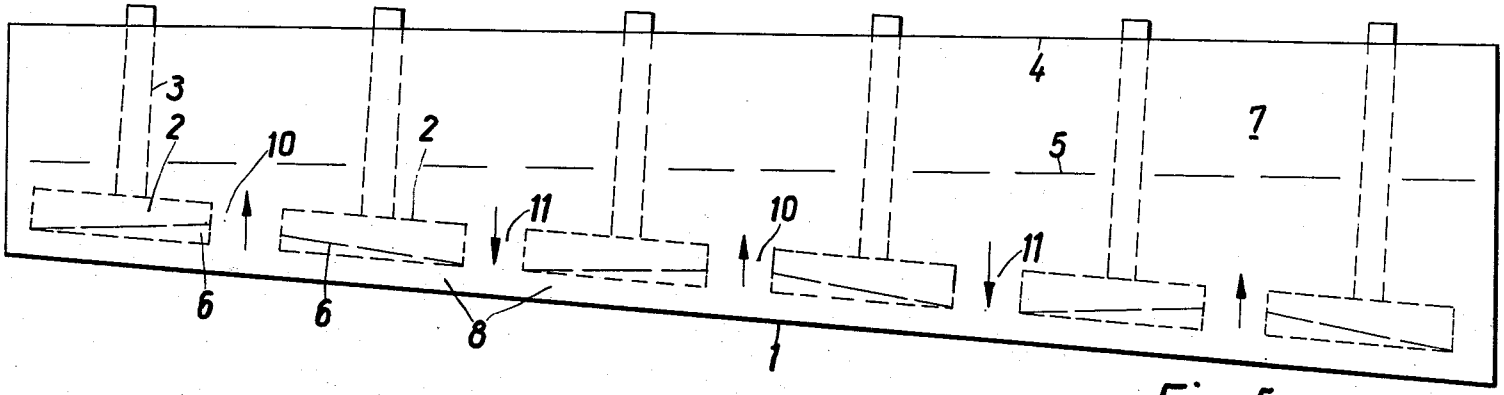
FIG. 5 is a side view of a mercury-type electrolytic cell having anodes (shown in phantom) in which the bottoms of the channel- or groovelike recesses are inclined in mutually opposite directions from the horizontal.

All electrolytic cells shown in FIGS. 1, 3, and 5 have cell bottoms 1 which cause mercury to flow from left to right. The anodes 2 have stems 3, which extend in the conventional manner through the cell cover 4. The cell is filled with brine approximately to the dotted line 5.

Figure 2:
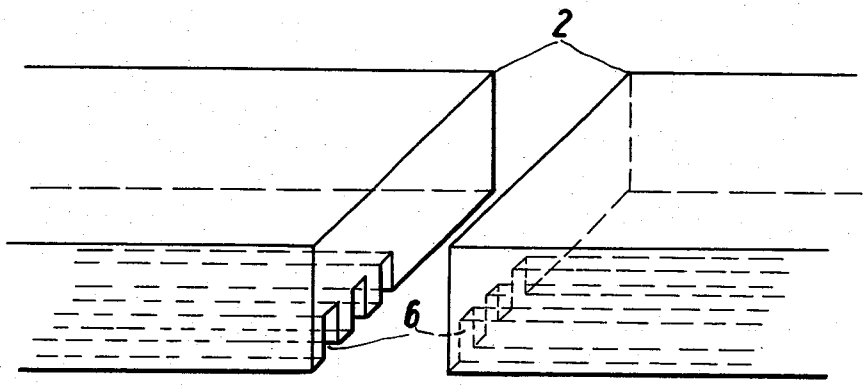
FIGS. 2, 4 and 6 are enlarged perspective views, partly broken away, showing the course of the channel- or groovelike recesses in the anodes of FIGS. 1,3, and 5 respectively.

According to FIG. 1, the anode 2 is provided on its active side with uniform recesses 6 which are rectangular in cross-section (FIG. 2). Because the anodes 2 have the same inclination as the cell bottom 1 the chlorine gas produced by the electrolysis flows in the form of a dispersion to the left and leaves the anode at its edge and finally enters the gas space 7. By a constant circulation, fresh brine from which chlorine gas has been removed flows into the space 8 between the electrodes. A partition 9 defines spaced apart regions for the outflow of chlorine and the inflow of brine as indicated by the arrows in FIG. 1. In this way, an entraining of gas-brine dispersion by the brine flowing into the space 8 between the electrodes at the adjacent anode and a supply of said dispersion into said space are reliably prevented.

Figure 4:
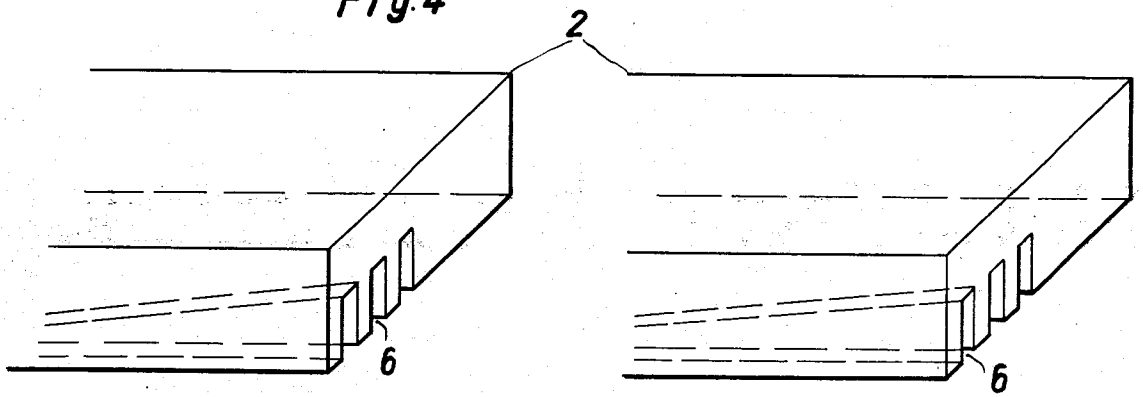

The recesses 6 of the anode 2 shown in FIGS. 3 and 4 progressively increase in the direction of flow of the mercury. In this case, the gas-brine dispersion flows to the right and the velocity of flow of the dispersion is increased by a component of motion which is due to the flow of mercury. Partitions 9 are also provided to prevent an entraining of gas-brine dispersion by the brine which flows into the space 8 between the electrodes at the adjacent anode 2.

Figure 6:
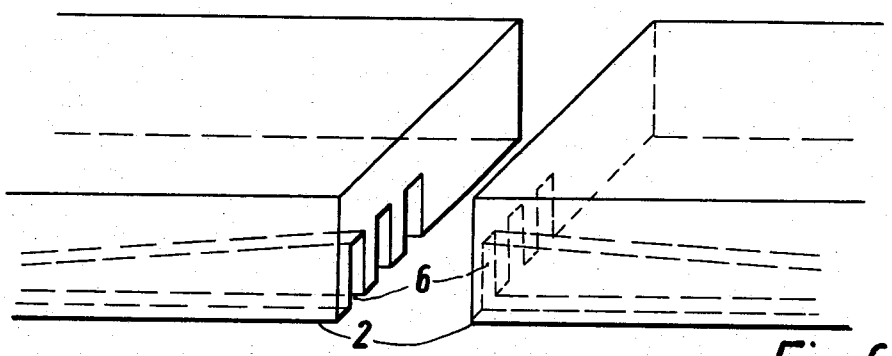

There is no need for a partition 9 in the embodiment of the invention shown in FIGS. 5 and 6, where the bottoms of the recesses 6 in adjacent anodes are inclined from the horizontal in mutually opposite directions so that the gasbrine dispersion flows to the right at the first anode 2 and to the left at the adjacent second anode 2. The dispersion flows out into a common gas outlet region 10. Brine is supplied through a brine inflow region 11, which is offset by one anode length and disposed on the right of the second anode 2 and on the left of the third anode 2. Because the regions for an outflow of the gas-brine dispersion and for an inflow of the brine are spaced by one anode length, an entraining of gas by the brine flowing into the space 8 between the electrodes will be reliably prevented.

What is claimed is:

1. Method for the electrolysis of alkali metal chlorides in a mercury cell having an inclined bottom over which the mercury flows which comprises carrying out the electrolysis in the presence of a series of spaced apart electrodes substantially parallel to said bottom which are free of apertures or perforations extending thru the thickness of the anode, said anodes having on their underside channel-or groovelike recesses extending in the direction of mercury flow, said anodes being positioned with partitions between adjacent anodes to cause a directed flow of brine at one end of each anode into the space between each anode and the mercury and an outflow of a chlorine-brine dispersion at the other end of each anode from the channel-or groovelike recesses thereof without mixing the emerging chlorine-brine dispersion and the entering brine in the regions between adjacent anodes.

2. Method of claim 1 wherein the anodes are positioned to cause said directed flow in a direction opposite to the mercury flow.

3. Method of claim 1 wherein the channel-or groovelike recesses increase in depth in the direction of mercury flow thereby causing said directed flow in the direction of mercury flow.

4. Method of claim 1 wherein the channel- or groovelike recesses occupy 20–80% of the area of the undersurface of the anodes.

5. Method of claim 1 wherein said anodes are of carbon.

6. Method for the electrolysis of alkali metal chlorides in a mercury cell having an inclined bottom over which the mercury flows which comprises carrying out the electrolysis in the presence of a series of spaced apart electrodes substantially parallel to said bottom which are free of apertures or perforations extending thru the thickness of the anode, said anodes having on their underside channel-or groovelike recesses extending in the direction of mercury flow, the recesses of adjacent anodes being inclined from the horizontal in mutually opposite directions to cause a directed flow of brine into alternate regions between adjacent anodes and an outflow of a chlorine-brine dispersion from the remaining alternate regions between adjacent anodes thereby spacing the respective inflow and outflow regions apart by the length of an anode to prevent mixing of the emerging chlorine-brine dispersion with the entering brine.

7. Method of claim 6 wherein the channel- or groovelike recesses occupy 20–80% of the area of the undersurface of the anodes.

8. Method of claim 6 wherein said anodes are of carbon.

* * * * *

UNITED STATES PATENT OFFICE

CERTIFICATE OF CORRECTION

Patent No. 3,951,767 Dated April 20, 1976

Inventor(s) Karl Lohrberg et al.

It is certified that error appears in the above-identified patent and that said Letters Patent are hereby corrected as shown below:

The drawing Figure on the Cover Sheet should read as shown on the attached sheet.

Signed and Sealed this

Fifteenth Day of February 1977

[SEAL]

*Attest:*

RUTH C. MASON
*Attesting Officer*

C. MARSHALL DANN
*Commissioner of Patents and Trademarks*

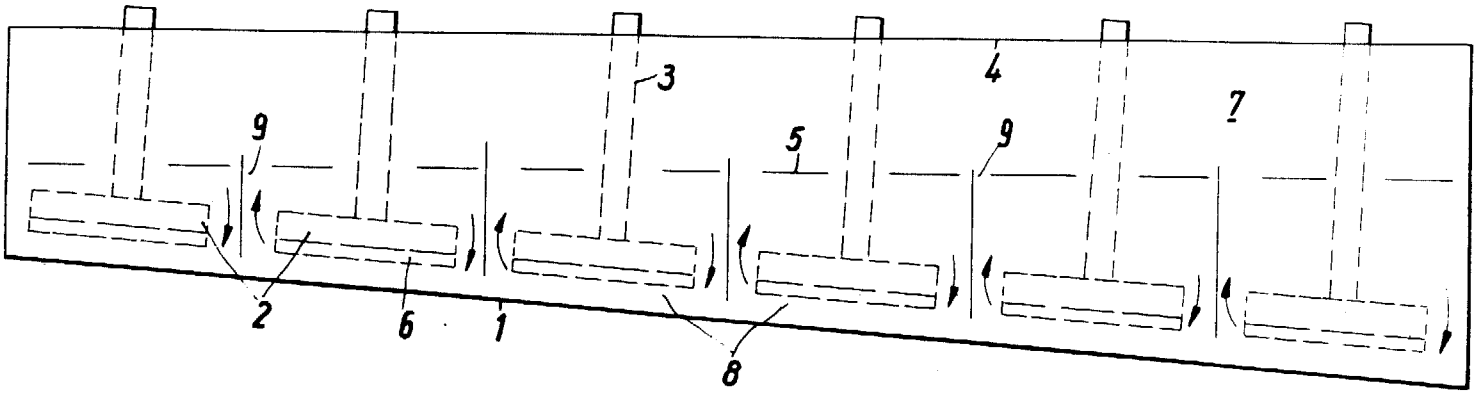
7
4
9
5
3
8
1
6
9
2